US009339097B2

(12) United States Patent
Weishaar et al.

(10) Patent No.: US 9,339,097 B2
(45) Date of Patent: May 17, 2016

(54) DEODORANT PACKAGE WITH EXPANDING PLATFORM

(71) Applicant: Tessy Plastics Corporation, Elbridge, NY (US)

(72) Inventors: James Weishaar, Canandaigua, NY (US); Eric Frearson, Syracuse, NY (US)

(73) Assignee: Tessy Plastics Corporation, Elbridge, NY (US)

( * ) Notice: Subject to any disclaimer, the term of this patent is extended or adjusted under 35 U.S.C. 154(b) by 0 days.

(21) Appl. No.: 14/577,485

(22) Filed: Dec. 19, 2014

(65) Prior Publication Data

US 2015/0173486 A1 Jun. 25, 2015

Related U.S. Application Data

(60) Provisional application No. 61/918,872, filed on Dec. 20, 2013.

(51) Int. Cl.

| | |
|---|---|
| ***B43K 21/08*** | (2006.01) |
| ***B43K 5/06*** | (2006.01) |
| ***A45D 40/04*** | (2006.01) |
| ***B43K 23/00*** | (2006.01) |
| ***B43K 5/12*** | (2006.01) |

(52) U.S. Cl.
CPC . *A45D 40/04* (2013.01); *B43K 5/06* (2013.01); *B43K 5/12* (2013.01); *B43K 21/08* (2013.01); *B43K 23/00* (2013.01)

(58) Field of Classification Search
CPC ..... A45D 40/04; B43K 5/06; B43K 23/00; B05C 17/00; B65D 83/00; A61K 8/04; A61K 7/025
USPC ..... 401/172–175, 68–87
See application file for complete search history.

(56) References Cited

U.S. PATENT DOCUMENTS

2012/0039656 A1* 2/2012 Baines ..... A45D 40/04 401/68

* cited by examiner

*Primary Examiner* — Mark A Laurenzi
*Assistant Examiner* — Thomas M Abebe
(74) *Attorney, Agent, or Firm* — Barclay Damon, LLP

(57) ABSTRACT

A deodorant package with an expanding platform is provided. The deodorant package has a threaded shaft connected to a rotatable dial. An elevator with an platform engages the threaded shaft. The platform has a first section joined to a second section by at least one flexible hinge such that the first section and the second section are biased to expand to contact an inner wall of the body of the package. An advantage that may be realized in the practice of some disclosed embodiments of the deodorant package is that a significant draft angle may be used that aids manufacturing.

20 Claims, 7 Drawing Sheets

DEODORANT PACKAGE WITH EXPANDING PLATFORM

CROSS-REFERENCE TO RELATED APPLICATIONS

This application claims priority from, and is a non-provisional of, U.S. patent application Ser. No. 61/918,872 (filed Dec. 20, 2013) the entirety of which is hereby incorporated by reference.

BACKGROUND OF THE INVENTION

The subject matter disclosed herein relates to deodorant packages and to injection molded deodorant packages in particular.

Draft angles are desirable when forming parts by injection molding, as they promote release of the molded product without distortion or damage. Unfortunately, the inclusion of draft angles in certain commercial products can be problematic. The package designer must choose to (1) minimize the draft angle which is not desirable, (2) increase the thickness of the sidewalls toward the top of the package which increases the cost of the package, or (3) maintain a constant side wall thickness and permit the internal diameter of the package to widen toward the top of the package. This widening of the internal diameter of the package can be problematic. In deodorant packages, for example, an elevator with a platform is used to push deodorant to a top of the package. If the package becomes wider at the top of the package, the platform will not contact the package along the widened sidewalls and the package will fail to properly dispense the deodorant.

The discussion above is merely provided for general background information and is not intended to be used as an aid in determining the scope of the claimed subject matter.

BRIEF DESCRIPTION OF THE INVENTION

A deodorant package with an expanding platform is provided. The deodorant package has a threaded shaft connected to a rotatable dial. An elevator with an platform engages the threaded shaft. The platform has a first section joined to a second section by at least one flexible hinge such that the first section and the second section are biased to expand to contact an inner wall of the body of the package. An advantage that may be realized in the practice of some disclosed embodiments of the deodorant package is that a significant draft angle may be used that aids manufacturing.

In a first embodiment, a deodorant package with an expanding platform is provided. The deodorant package comprises a body defining a cavity for receiving deodorant; a threaded shaft connected to a rotatable dial, the threaded shaft being connected to the rotatable dial such that rotation of the rotatable dial causes the threaded shaft to rotate; and a platform comprising a threaded region that engages the threaded shaft such that rotation of the threaded shaft causes the platform to traverse along the threaded shaft, the platform comprising a first section joined to a second section by at least one flexible hinge such that the first section and the second section are biased to expand to contact an inner wall of the body.

In a second embodiment, a deodorant package with an expanding platform is provided. The deodorant package comprises a body defining a cavity for receiving deodorant; a threaded shaft connected to a rotatable dial, the threaded shaft being connected to the rotatable dial such that rotation of the rotatable dial causes the threaded shaft to rotate; and a platform comprising a threaded region that engages the threaded shaft such that rotation of the threaded shaft causes the platform to traverse along the threaded shaft, the platform comprising a first section joined to a second section by a plurality of flexible hinges such that the first section and the second section are biased to expand to contact an inner wall of the body.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION OF THE INVENTION

Figure 1A:
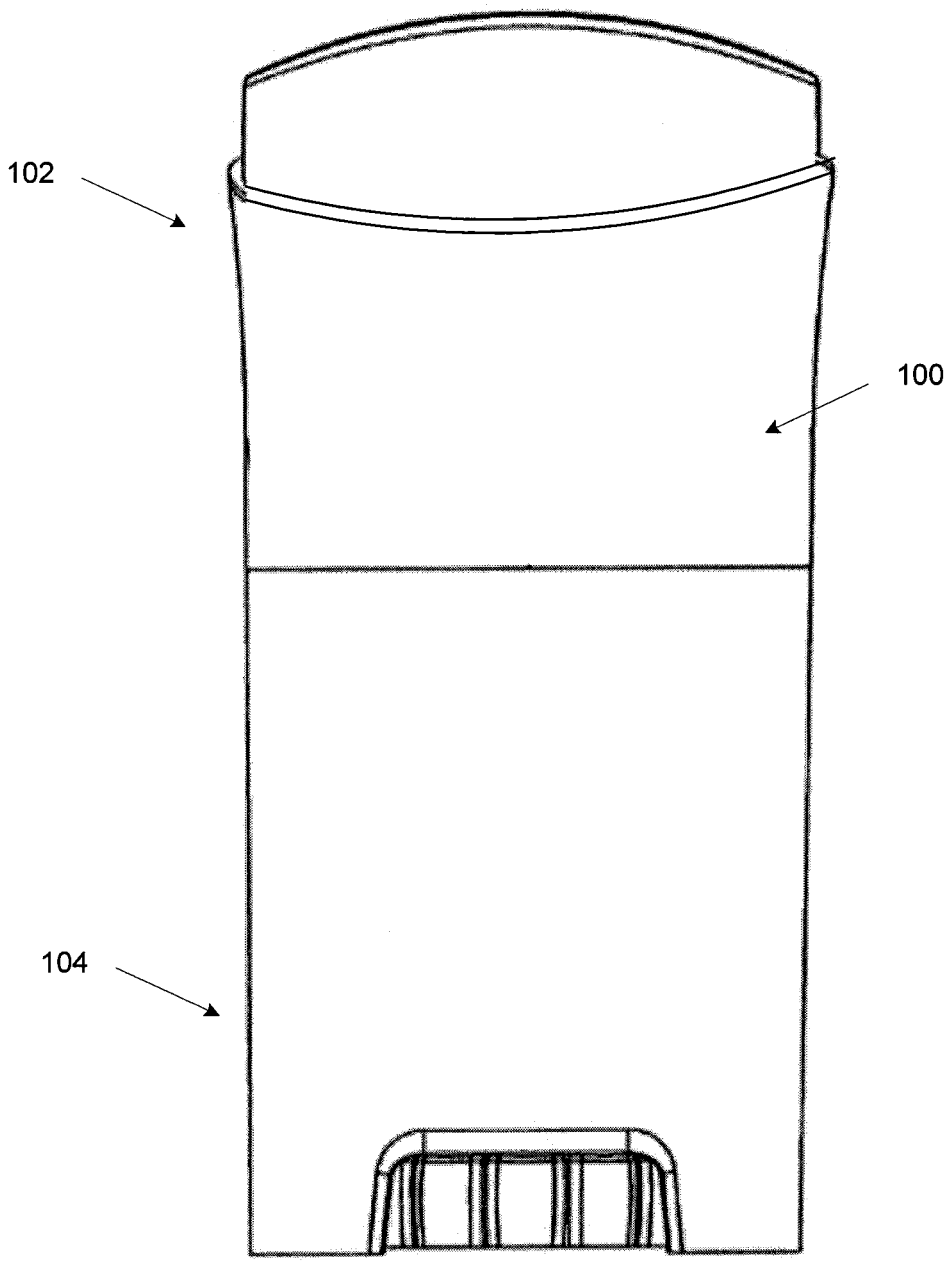
FIG. 1A is a plan view of an exemplary deodorant package.
Figure 1B:
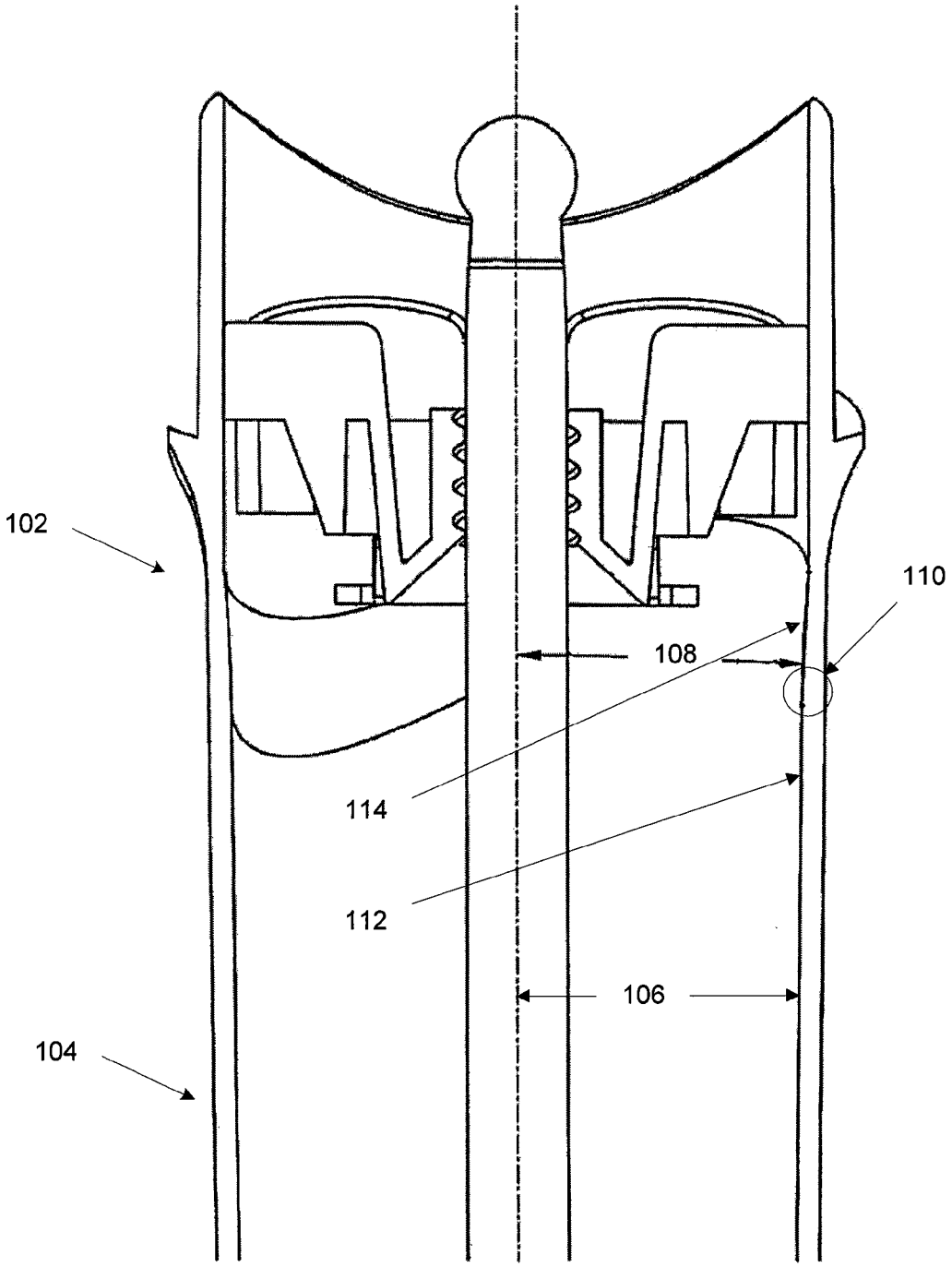
FIG. 1B is a cross section view of the exemplary deodorant package.

FIG. 1A depicts a side view of an exemplary deodorant package 100. The deodorant package 100 has sidewalls that provide a draft angle. The draft angle is formed by the sidewalls providing an internal diameter near a top portion 102 of deodorant package 100 that is wider than near a bottom portion 104. For example, as shown in FIG. 1B, the bottom portion 104 has a first radius 106 while the top portion 102 has a second radius 108, wherein the second radius 108 is greater than the first radius 106. This difference provides a draft angle at point 110 between an inner wall 112 of the bottom portion and an inner wall 114 of the top portion. In the embodiment of FIG. 1B, the draft angle is about 3.09°. To accommodate for such a draft angle, an elevator with a platform 200 (see FIG. 2) is provided. The components of deodorant package 100 may be formed by, for example, injection molding techniques. When such a technique is used, the platform 200 expands during operation of the deodorant package 100 and permits a package designer to provide a significant draft angle. Such a draft angle is advantageous when using injection molding techniques.

Figure 2:
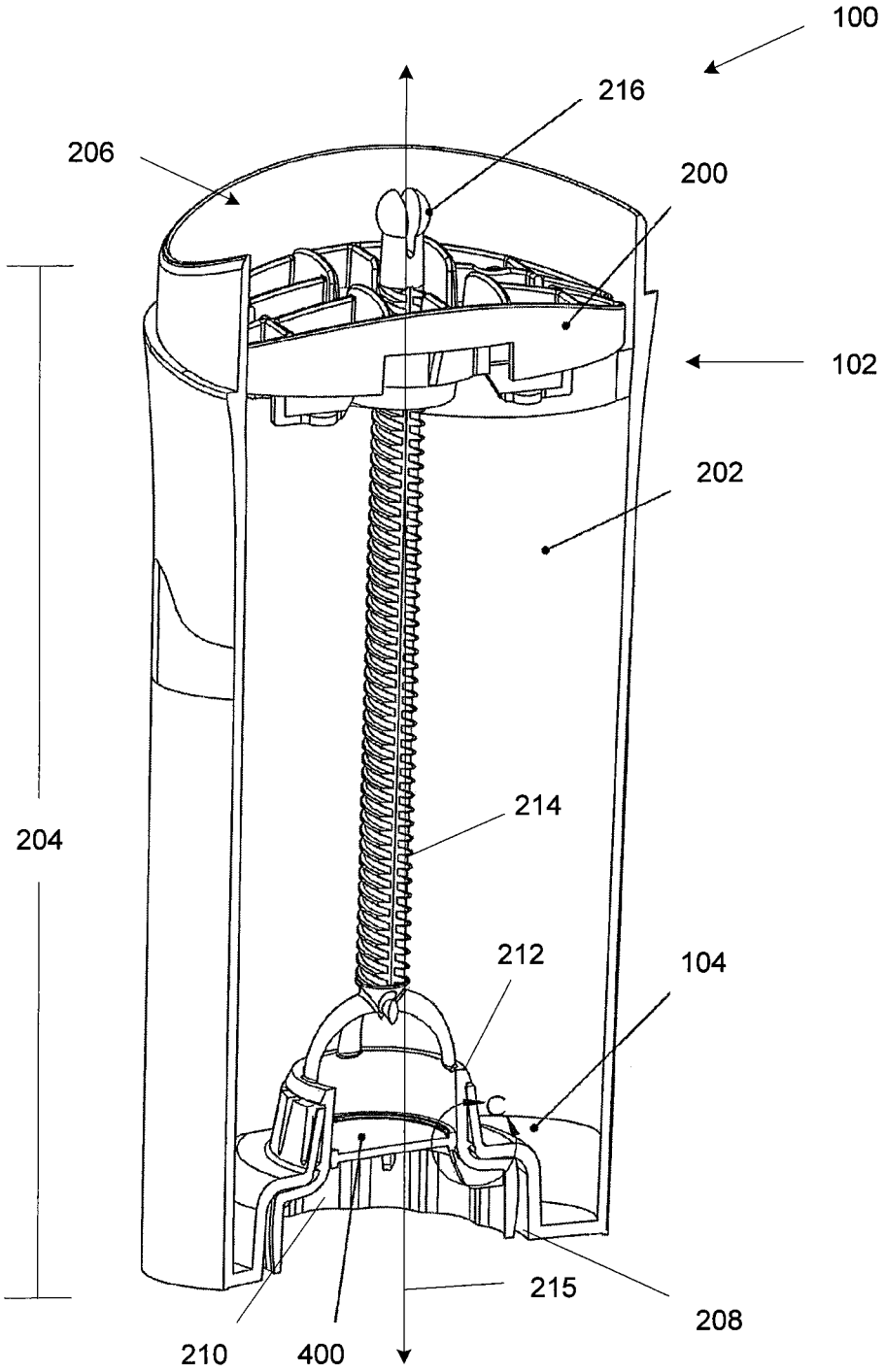
FIG. 2 is another cross section view of the exemplary deodorant package.

FIG. 2 is a cross section view of the deodorant package 100 showing the platform 200. The deodorant package 100 comprises a body 202 that has an internal diameter that varies over at least a portion of length 204 due to a draft angle. The body 202 has a mouth 206 proximate the top portion 102 and a hole 208 proximate the bottom portion 104. A rotatable dial 210 is inserted into the hole 208 and locks in place with a lock 212. The rotatable dial 210 comprises a threaded shaft 214 which extends toward the top portion 102 along a vertical axis 215. The threaded shaft 214 engages a corresponding threaded region 302 (see FIG. 3) on the platform 200. The threaded shaft 214 terminates with a platform retention feature 216 that ensure the platform 200 will remain on the threaded shaft 214. As the rotatable dial 210 is actuated, the threaded shaft 214 rotates and causes the platform 200 to traverse along the length 204. A removable plug 400 is provided that fits into an opening in the rotatable dial 210. The opening is used to add deodorant into the body. The removable plug 400 is then used to close the opening prior sale. A more detailed view of the platform 200 is provided in FIG. 3.

Figure 3:
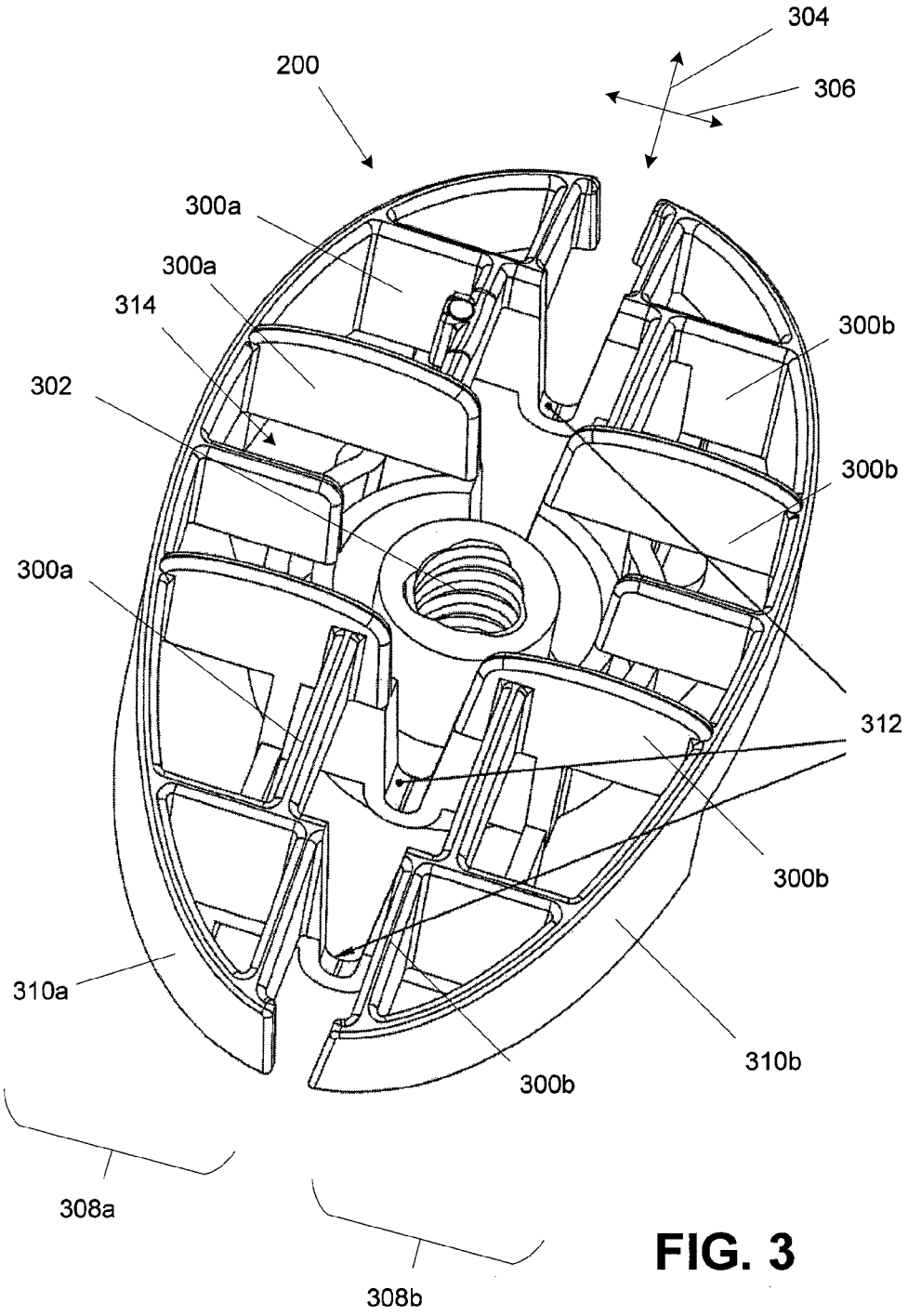
FIG. 3 is a depiction of an expanding platform for use with the exemplary deodorant package.

FIG. 3 is a bottom perspective view of an exemplary platform 200. The platform 200 may be formed from a polymeric material, such as high density polyethylene (HDPE). The platform 200 comprises ribs 300*a*/300*b* arranged about the threaded region 302. The platform 200 provides a generally planar surface and has an elliptical shape that extends in a longitudinal direction 304 and a traverse direction 306, which is perpendicular the longitudinal direction 304. The platform 200 is bisected along a center longitudinal axis into a first section 308*a* and a second section 308*b*. The first section 308*a* comprises ribs 300*a* that extend along the traverse direction 206 and a first edge wall 310*a*. Each of the ribs 300*a* terminates at the first edge wall 310*a*. The second section 308*b* comprises ribs 300*b* and a second edge wall 310*b*. Each of the ribs 300*b* terminates at the second edge wall 310*b*. The ribs provide at least one hole 314 that is useful during manufacturing: warm deodorant can flow through the hole 314. The first section 308*a* and second section 308*b* are connected by flexible hinges 312. The flexible hinges 312 provide an outward force that expands the first section 308*a* and the second section 308*b* along the traverse direction 306. Such a configuration permits flexible hinges 312 to provide a biased tension against the sidewalls of the body 202. Accordingly, as the platform 200 travels from the bottom portion 104 (where the internal diameter is relatively small) toward the top portion 102 (where the internal diameter is relatively large), the bias provided by the flexible hinges 312 causes the first and second common edge walls 310*a*/310*b* to remain in contact with the sidewalls of the body 202.

Many deodorants contain liquids to provide moisture and/or volatile fragrances that may escape the package before the package is purchased by a consumer.

In one embodiment, a mechanism for sealing a deodorant package while it is being stored for sale is provided. In use deodorant packages, such as deodorant package 100, are filled by disposing the platform 200 near the bottom portion 104. The deodorant package 100 is inverted and liquid deodorant is added through an opening in the rotatable dial 210. Openings between the ribs 300*a*/300*b* permit the liquid deodorant to flow through the platform 200 and contact a lid (not shown) of the deodorant package 100. The liquid deodorant is permitted to solidify by, for example, cooling.

Figure 4:
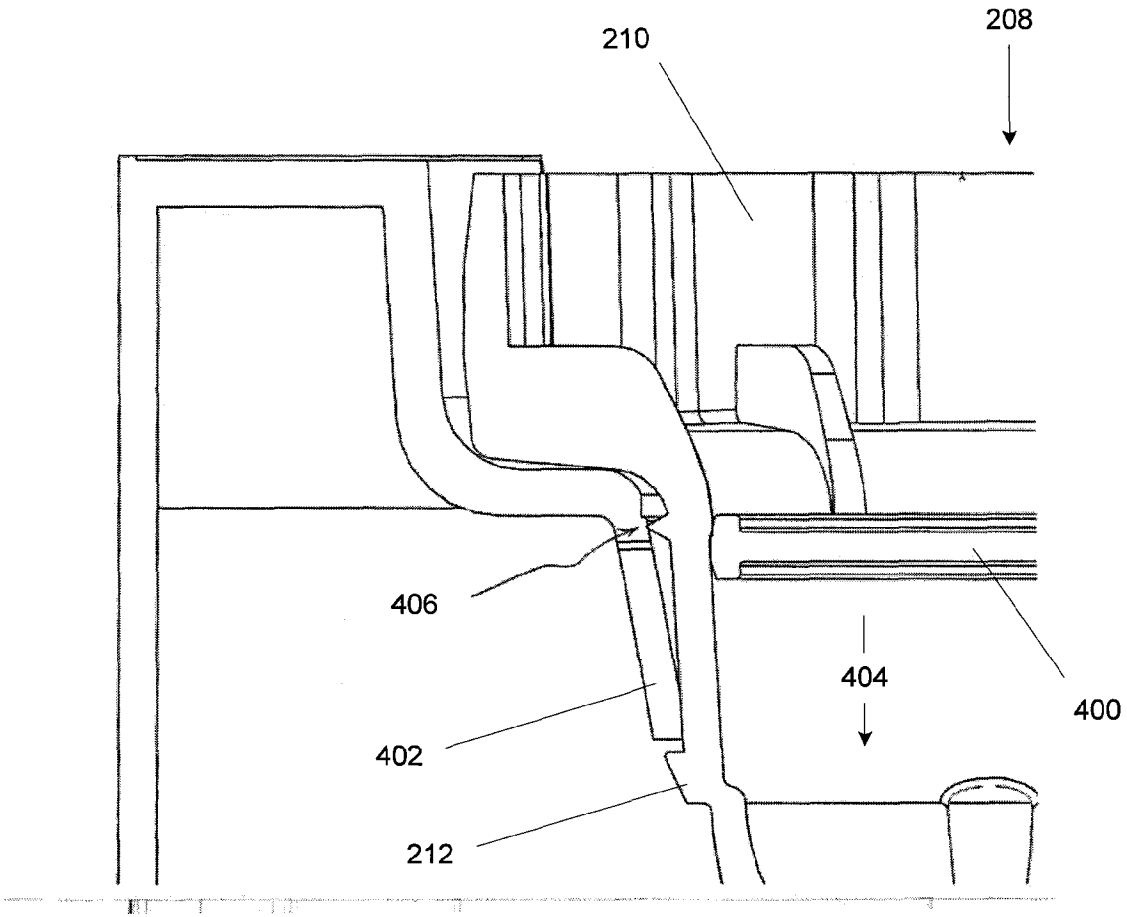
FIG. 4 is an expanded view of a cross section of a dial of the exemplary deodorant package showing the dial in a pre-use condition.

Referring to FIG. 4, the hole 208 is defined by a wall 402. The rotatable dial 210 disposed within the hole 208 such that a lock 212 engages the wall 402 to retain the rotatable dial 210 within the hole 208. In the embodiment of FIG. 4, the lock 212 is a protrusion on the rotatable dial 210 that has a diameter larger than a diameter of the hole 208. The wall 402 is semi-flexible and has an inward slant such that the lock 212 can be inserted into the hole 208 to cause the wall 402 to flex outward, and thereafter snap back to the hole's original diameter to retain the lock 212.

After deodorant has been added, the plug 400 is inserted into the rotatable dial 210 to seal the package. As the plug 400 is pressed in the direction of arrow 404, the rotatable dial 210 likewise moves in the direction of arrow 404. This motion causes a protrusion 406 to engage the wall 402. In the embodiment depicted, the protrusion 406 is coplanar with the plug 400 to promote this engagement. In one embodiment, the protrusion 406 is configured to embed into the wall 402 to provide a seal. This seal promotes the retention of moisture and/or fragrances within the deodorant package 100 until such time as the consumer uses the product.

Figure 5:
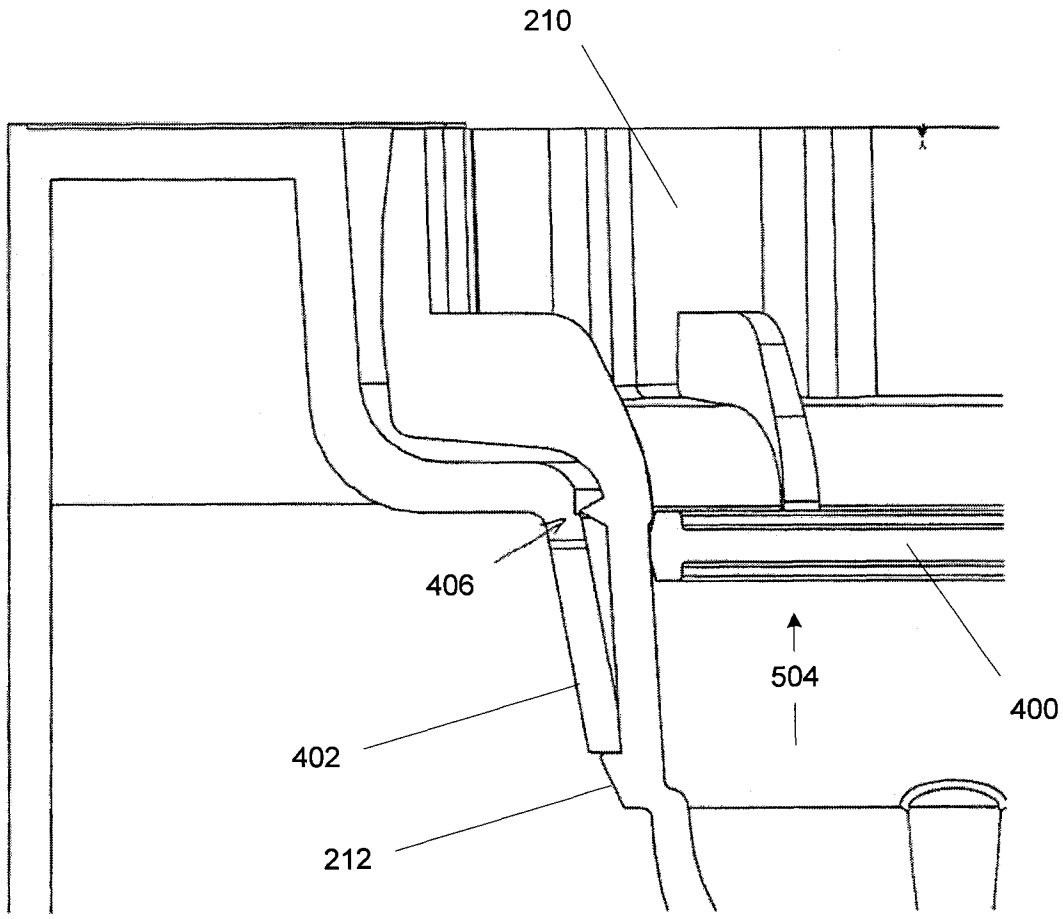
FIG. 5 is an expanded view of a cross section of the dial of the exemplary deodorant package showing the dial in a post-use condition.

As shown in FIG. 5, the consumer's first use of the deodorant package 100 turns the rotatable dial 210 an initial attempt to move the platform 200. This turning applies a force in the direction of arrow 504 as the platform's first attempt to move upward causes a counter-force to be generated. When sufficient downward force has been applied, the protrusion 406 is dislodged from wall 402 and the rotatable dial 210 moves until the lock 212 engages the top of wall 402. Once the lock 212 is so engaged, further turning of the rotatable dial 210 causes the platform 200 to move such that deodorant is dispensed from the deodorant package 100.

Figure 6B:
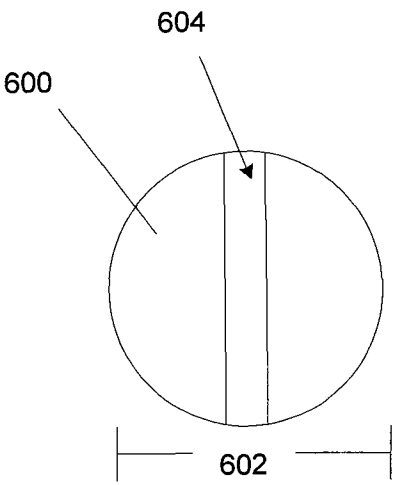
FIG. 6A and FIG. 6B are schematic depictions of a platform retention feature for use with the exemplary deodorant package.
Figure 6A:
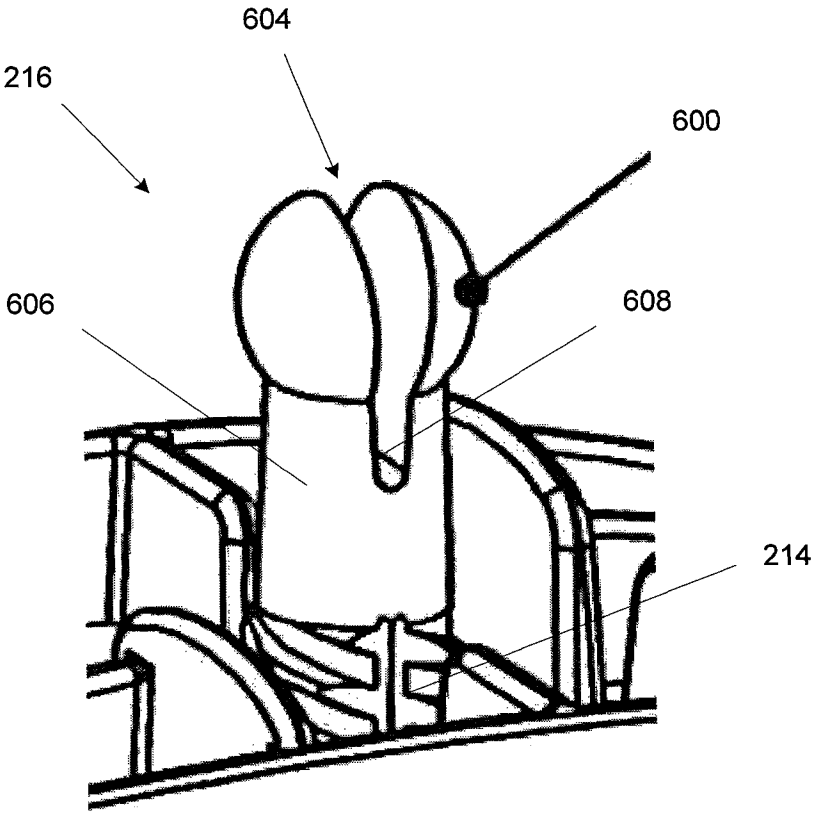

FIG. 6A and FIG. 6B are more detailed views of the platform retention feature 216. The platform retention feature 216 comprises a wide portion 600 that has a width 602 that is wider than a width of the threaded region 302 (see FIG. 3) on the platform 200. In the embodiment depicted in FIG. 6A and FIG. 6B, the wide portion 600 is ball-shaped. The wide portion 600 comprises a slot 604 with a hinge point 608. During assembly, the platform retention feature 216 is pressed against the threaded region 302 which causes the slot 604 to be compressed to permit the wide portion 600 to pass through the threaded region 302. The threaded region 302 passes over an unthreaded portion 606 before engaging the threaded shaft 214. As the platform 200 reaches the top, the platform eventually contacts the unthreaded portion 606. Since there are no threads, further turning of the rotatable dial 210 will not cause the platform 200 to fall off. Additionally, due to the presence of the platform retention feature 216, the platform 200 is retained within the deodorant package 100, even if the deodorant package 100 were, for example, inverted.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A deodorant package with an expanding platform, the deodorant package comprising:

a body defining a cavity for receiving deodorant;

a threaded shaft connected to a rotatable dial, the threaded shaft being connected to the rotatable dial such that rotation of the rotatable dial causes the threaded shaft to rotate; and a platform comprising a threaded region that engages the threaded shaft such that rotation of the threaded shaft causes the platform to traverse along the threaded shaft, the platform comprising a first section joined to a second section by at least one flexible hinge such that the first section and the second section are biased to expand to contact an inner wall of the body.

2. The deodorant package of claim 1, wherein the first section of the platform further comprises a first edge wall that contacts the inner wall of the body and the second section of the platform further comprises a second edge wall that contacts the inner wall of the body.

3. The deodorant package of claim 2, wherein the first edge wall is connected to the flexible hinge by at least one rib such that at least one hole is present in the platform.

4. The deodorant package of claim 1, wherein the body has an internal diameter that varies over at least a portion of its length due to a draft angle, the platform accommodating the draft angle by expanding.

5. The deodorant package of claim 1, wherein the rotatable dial has a plug that seals an opening of the body.

6. The deodorant package of claim 5, wherein the rotatable dial is disposed within a hole, the hole defined by an inwardly sloping wall.

7. The deodorant package of claim 6, wherein the rotatable dial has an outwardly extending protrusion that contacts the inwardly sloping wall of the hole.

8. The deodorant package of claim 7, wherein the protrusion forms a seal with the inwardly sloping wall by partially forcing the inwardly sloping wall outward, wherein the seal is broken upon first rotation of the rotatable dial.

9. The deodorant package of claim 7, wherein the protrusion forms a seal with the inwardly sloping wall by partially forcing the inwardly sloping wall outward, wherein the seal is formed when the plug is inserted.

10. A deodorant package with an expanding platform, the deodorant package comprising:

a body defining a cavity for receiving deodorant;

a threaded shaft connected to a rotatable dial, the threaded shaft being connected to the rotatable dial such that rotation of the rotatable dial causes the threaded shaft to rotate; and a platform comprising a threaded region that engages the threaded shaft such that rotation of the threaded shaft causes the platform to traverse along the threaded shaft, the platform comprising a first section joined to a second section by a plurality of flexible hinges such that the first section and the second section are biased to expand to contact an inner wall of the body.

11. The deodorant package of claim 10, wherein the first section of the platform further comprises a first edge wall that contacts the inner wall of the body and the second section of the platform further comprises a second edge wall that contacts the inner wall of the body.

12. The deodorant package of claim 11, wherein the first edge wall is connected to each flexible hinge in the plurality of flexible hinges by at least one rib such that at least one hole is present in the platform.

13. The deodorant package of claim 11, wherein the body has an internal diameter that varies over at least a portion of its length due to a draft angle, the platform accommodating the draft angle by expanding.

14. The deodorant package of claim 11, wherein the rotatable dial has a plug that seals an opening of the body.

15. The deodorant package of claim 14, wherein the rotatable dial is disposed within a hole, the hole defined by an inwardly sloping wall.

16. The deodorant package of claim 15, wherein the rotatable dial has an outwardly extending protrusion that contacts the inwardly sloping wall of the hole.

17. The deodorant package of claim 16, wherein the protrusion forms a seal with the inwardly sloping wall by partially forcing the inwardly sloping wall outward, wherein the seal is broken upon first rotation of the rotatable dial.

18. The deodorant package of claim 16, wherein the protrusion forms a seal with the inwardly sloping wall by partially forcing the inwardly sloping wall outward, wherein the seal is formed when the plug is inserted.

19. The deodorant package of claim 10, wherein the threaded shaft terminates in a platform retention feature with a wide portion that is wider than the thread shaft, the platform retention feature being divided into two sections at a hinge point such that the platform retention feature may be inserted through the threaded region of the platform by compressing the platform retention feature at the hinge point.

20. The deodorant package of claim 19, wherein the threaded shaft comprises an unthreaded portion that directly contacts the platform retention feature.

* * * * *